US005873017A

United States Patent [19]

Soga et al.

[11] Patent Number: 5,873,017

[45] Date of Patent: Feb. 16, 1999

[54] IMAGE FORMING APPARATUS

[75] Inventors: Setsuo Soga; Hideo Yu; Jun Okamoto; Yasuhiro Kohira, all of Tokyo, Japan

[73] Assignee: Ricoh Company Ltd., Tokyo, Japan

[21] Appl. No.: 831,018

[22] Filed: Mar. 31, 1997

[30] Foreign Application Priority Data

| | | | |
|---|---|---|---|
| Apr. 1, 1996 | [JP] | Japan | 8-106088 |
| Apr. 1, 1996 | [JP] | Japan | 8-106089 |
| Jul. 19, 1996 | [JP] | Japan | 8-207696 |
| Jul. 30, 1996 | [JP] | Japan | 8-215925 |

[51] Int. Cl.[6] ..... G03G 15/01

[52] U.S. Cl. ..... 399/302; 399/303; 399/308; 399/310

[58] Field of Search ..... 399/298, 302, 399/303, 308, 310–317; 430/124, 126

[56] References Cited

U.S. PATENT DOCUMENTS

| | | | |
|---|---|---|---|
| 5,187,526 | 2/1993 | Zaretsky | 399/302 |
| 5,291,252 | 3/1994 | Kawaishi | 399/301 |
| 5,428,429 | 6/1995 | Fletcher | 399/308 |
| 5,438,398 | 8/1995 | Tanigawa et al. | 399/302 |
| 5,442,428 | 8/1995 | Takahashi et al. . | |
| 5,455,663 | 10/1995 | Inoue et al. | 399/303 |
| 5,572,304 | 11/1996 | Seto et al. | 399/313 |
| 5,640,645 | 6/1997 | Namekata et al. | 399/302 X |
| 5,655,199 | 8/1997 | Yamashita et al. | 399/302 |
| 5,697,031 | 12/1997 | Kamiya et al. | 399/302 X |
| 5,701,568 | 12/1997 | Hiroshima et al. | 399/302 |
| 5,701,569 | 12/1997 | Kanazawa et al. | 399/308 |
| 5,758,226 | 5/1998 | Motohashi | 399/302 X |

FOREIGN PATENT DOCUMENTS

| | | |
|---|---|---|
| 40 40 962 A1 | 6/1991 | Germany . |
| 41 39 409 C2 | 6/1992 | Germany . |
| 195 02 098 A1 | 11/1995 | Germany . |
| 195 23 767 A1 | 1/1996 | Germany . |

*Primary Examiner*—Matthew S. Smith

*Attorney, Agent, or Firm*—Oblon, Spivak, McClelland, Maier & Neustadt, P.C.

[57] ABSTRACT

An image forming apparatus of the type transferring a toner image from a photoconductive element to a recording medium by way of an intermediate transfer belt is disclosed. Toner images of different colors are sequentially transferred from the photoconductive element to the intermediate transfer belt one above the other, forming a full-color image. When the full-color image is to be transferred from the intermediate transfer belt to a paper or similar recording medium, a secondary transfer belt is brought into contact with the portion of the intermediate transfer belt contacting a secondary transfer roller. As a result, the secondary transfer belt deforms complementarily to the shape of the secondary transfer roller, forming a nip between it and the intermediate transfer belt. In this condition, the secondary transfer belt contacts the intermediate transfer belt evenly and prevents an excessive pressure from acting locally on the toner image existing on the intermediate transfer belt.

13 Claims, 11 Drawing Sheets

IMAGE FORMING APPARATUS

BACKGROUND OF THE INVENTION

1. Field of the Invention

The present invention relates to an image forming apparatus of the type transferring a toner image from a photoconductive element to a recording medium by way of an intermediate transfer belt. More particularly, the present invention is concerned with a full-color image forming apparatus capable of forming attractive images free from defects including local or vermicular omission.

2. Discussion of the Background

It is a common practice with a full-color image forming apparatus to sequentially transfer toner images of different colors from a photoconductive element to an intermediate transfer belt one above the other, and then transfer the resulting composite or full-color image from the belt to a paper or similar recording medium, as taught in, e.g., Japanese Patent Laid-Open Publication No. 2-282491 or 5-210316. In this type of apparatus, a secondary transfer roller is held in contact with the inner periphery of the belt. A paper transfer roller faces the secondary transfer roller with the intermediary of the belt. The belt carries a toner image thereon. While a bias for image transfer is applied to the sheet transfer roller, the transfer roller is pressed against the portion of the belt contacting the secondary transfer roller. As a result, the toner image is transferred from the belt to a paper or similar recording medium being passed between the belt and the roller. The image transfer from the belt to the paper is referred to as secondary transfer, as distinguished from primary transfer from the photoconductive element to the belt.

However, the conventional apparatus having the above construction has the following problems. When the paper transfer roller is pressed against the intermediate transfer belt for the secondary transfer, the transfer roller locally presses the toner image deposited on the belt in the form of a layer and thereby compresses it. As a result, the parting ability of the toner and the surface of the belt from each other is lowered. This causes the toner to locally remain on the belt after the secondary transfer. Therefore, the image transferred to the paper is partly lost in a vermicular configuration.

Further, an air gap exists around the inlet of the nip between the secondary transfer roller and the paper transfer roller. Electric lines of force (electric field) are formed in the air gap due to a transfer bias. Consequently, the toner is scattered around at the position upstream of the nip and caused to deposit on the paper, resulting in a blurred or otherwise defective image.

SUMMARY OF THE INVENTION

It is therefore an object of the present invention to provide an image forming apparatus capable of forming an attractive image free from defects including local or vermicular omission.

In accordance with the present invention, an image forming apparatus includes a primary transfer unit having a primary transfer section and a secondary transfer belt. The primary transfer section sequentially transfers toner images of different colors from a photoconductive element to an intermediate transfer belt having a medium resistance to thereby form a composite color image on the intermediate transfer belt. The secondary transfer roller faces the inner periphery of the intermediate transfer belt for causing the belt to contact a recording medium. A secondary transfer unit transfers the composite toner image from the intermediate transfer belt to the recording medium. The second transfer unit includes a secondary transfer belt having a medium resistance, and a bias applying member facing the secondary transfer roller with the intermediary of the secondary transfer belt.

Also, in accordance with the present invention, an image forming apparatus includes a primary transfer unit for sequentially transferring toner images of different colors from a photoconductive element to an intermediate transfer belt having a medium resistance to thereby form a composite color image on the intermediate transfer belt. The primary transfer unit includes two secondary transfer rollers facing the inner periphery of the intermediate transfer belt and spaced by a preselected distance in the direction in which a recording medium is conveyed. A secondary transfer unit transfers the composite toner image from the intermediate transfer belt to the recording medium, and includes a secondary transfer belt having a medium resistance, a ground roller, and a bias applying member. The secondary transfer belt extends in the above direction. The ground roller faces the portion of the inner periphery of the secondary transfer belt facing the intermediate between the two secondary transfer rollers. The bias applying member faces the inner periphery of the secondary transfer belt at a position downstream of the downstream one of the two secondary transfer rollers with respect to the above direction.

Further, in accordance with the present invention, an image forming apparatus includes a primary transfer unit for sequentially transferring toner images of different colors from a photoconductive element to an intermediate transfer belt having a medium resistance to thereby form a composite color image on the intermediate transfer belt. The primary transfer unit includes two secondary transfer rollers facing the inner periphery of the intermediate transfer belt and spaced by a preselected distance in the direction in which a recording medium is conveyed. A secondary transfer unit transfers the composite toner image from the intermediate transfer belt to the recording medium, and includes a secondary transfer belt having a medium resistance, a secondary transfer member, and a conductive elastic member. The secondary transfer belt extends in the above direction. The secondary transfer member faces the portion of the inner periphery of the secondary transfer belt the downstream of downstream one of the two secondary transfer rollers with respect to the above direction. The conductive elastic member faces upstream one of the two secondary transfer rollers with respect to the above direction with the intermediary of the second transfer belt and is connected to ground.

Moreover, in accordance with the present invention, an image forming apparatus includes a primary transfer unit for sequentially transferring toner images of different colors from a photoconductive element to an intermediate transfer belt to thereby form a composite color image on the intermediate transfer belt. A secondary transfer unit transfers the composite toner image from the intermediate transfer belt to a recording medium, and includes a secondary transfer belt extending in the direction in which the recording medium is conveyed, and a secondary transfer member facing the inner periphery of the secondary transfer belt. The intermediate transfer belt is formed of a material having a volume resistivity of $10^8$ Ωcm to $10^{10}$ Ωcm. The secondary transfer belt is formed of a material having a volume resistivity of higher than $10^{11}$ Ωcm inclusive.

BRIEF DESCRIPTION OF THE DRAWINGS

The above and other objects, features and advantages of the present invention will become apparent from the following detailed description taken with the accompanying drawings in which.

In the drawings, the same or similar structural elements are designated by the same reference numerals.

DESCRIPTION OF THE PREFERRED EMBODIMENTS

Figure 1:
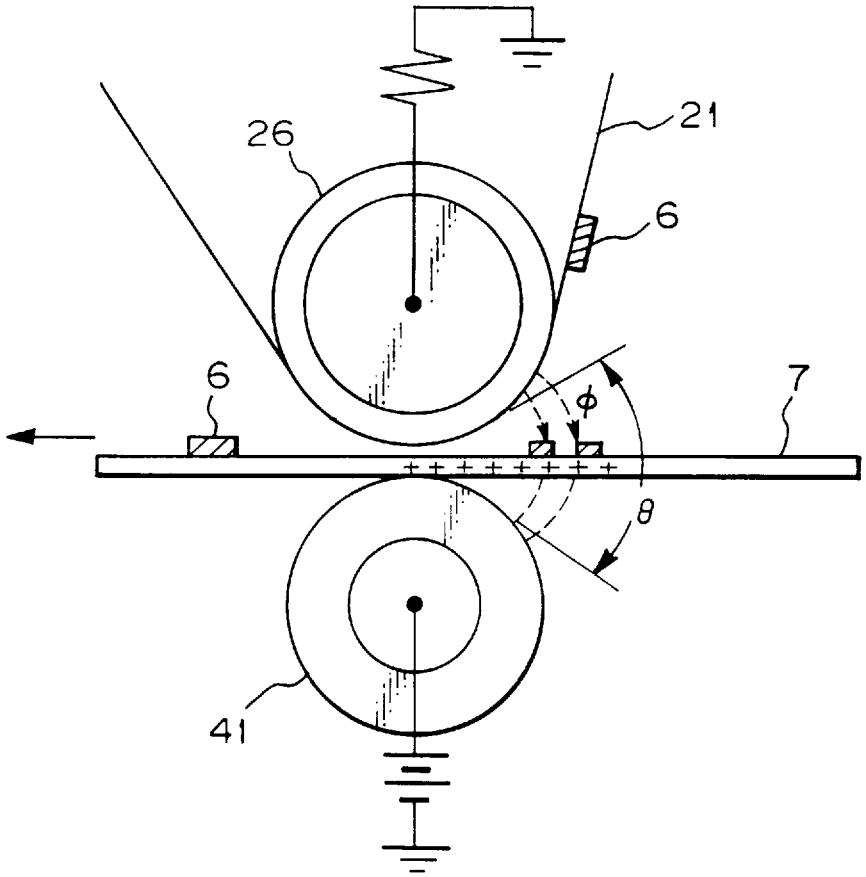
Fig. 1 PRIOR ART
FIG. 1 shows a secondary transfer section included in a conventional image forming apparatus of the type using an intermediate transfer belt.

To better understand the present invention, a brief reference will be made to a conventional image forming apparatus, shown in FIG. 1. The apparatus to be described is a full-color image forming apparatus of the type sequentially transferring toner images of different colors from a photoconductive element to an intermediate transfer belt one above the other, and transferring the resulting composite or full-color image from the belt to a paper or similar recording medium. As shown, the apparatus includes an intermediate transfer belt 21 having a medium resistance (surface resistance; $1\times10^{7}$ Ω to $1\times10^{13}$ Ω). A secondary transfer roller 26 also having a medium resistance is held in contact with the inner periphery of the belt 21 and is connected to ground. A sheet transfer roller 41 faces the secondary transfer roller 26 with the intermediary of the belt 21. The belt 21 carries a toner image 6 thereon. While a bias for image transfer is applied to the sheet transfer roller 41, the roller 41 is pressed against the portion of the belt 21 contacting the secondary transfer roller 26. As a result, the toner image 6 is transferred from the belt 21 to a paper 7 being passed between the belt 21 and the roller 41. The apparatus with this configuration has some problems left unsolved, as discussed earlier.

Preferred embodiments of the image forming apparatus in accordance with the present invention will be described which are free from the drawbacks of the conventional apparatus.

1st Embodiment

First, the general construction of an image forming apparatus embodying the present invention will be outlined. The apparatus is generally made up of an image forming unit, a primary transfer unit, a secondary transfer unit, and a fixing unit. The image forming unit sequentially forms toner images of different colors on the surface of a photoconductive element. The primary transfer unit includes a primary transfer section, an intermediate transfer belt having a medium resistance, and a secondary transfer roller. The primary transfer portion sequentially transfers the toner images from the photoconductive element to the intermediate transfer belt (primary transfer). The secondary transfer roller is held in contact with the inner periphery of the belt in order to cause the belt to contact a paper or similar recording medium. The secondary transfer unit includes a secondary transfer belt having a medium resistance, and bias applying means. When the toner image is to be transferred from the intermediate transfer belt to the paper (secondary transfer), the secondary transfer belt presses the paper against the intermediate transfer belt. At this instant, the bias applying means charges the paper being conveyed by the secondary transfer belt, thereby transferring the toner image from the intermediate transfer belt to the paper.

At the time of the secondary transfer, the secondary transfer belt is pressed against the portion of the intermediate transfer belt contacting the secondary transfer roller, as stated above. As a result, the secondary transfer belt deforms complementarily to the shape of the secondary transfer roller, forming a nip between it and the intermediate transfer belt. In this condition, the secondary transfer belt contacts the intermediate transfer belt evenly over the range or width of the nip. This successfully prevents an excessive pressure from acting locally on the toner forming a toner image on the intermediate transfer belt.

Further, because the secondary transfer belt deforms complementarily to the shape of the secondary transfer roller, an air gap around the nip is reduced. Consequently, electric lines of force (electric field) generated by the secondary transfer bias around the nip are reduced. Moreover, an inlet seal member is positioned on the portion of the bias applying means upstream of the secondary transfer belt. The seal member limits the charging width of the bias applying means and thereby further reduces the above electric lines of force (electric field).

Figure 2:
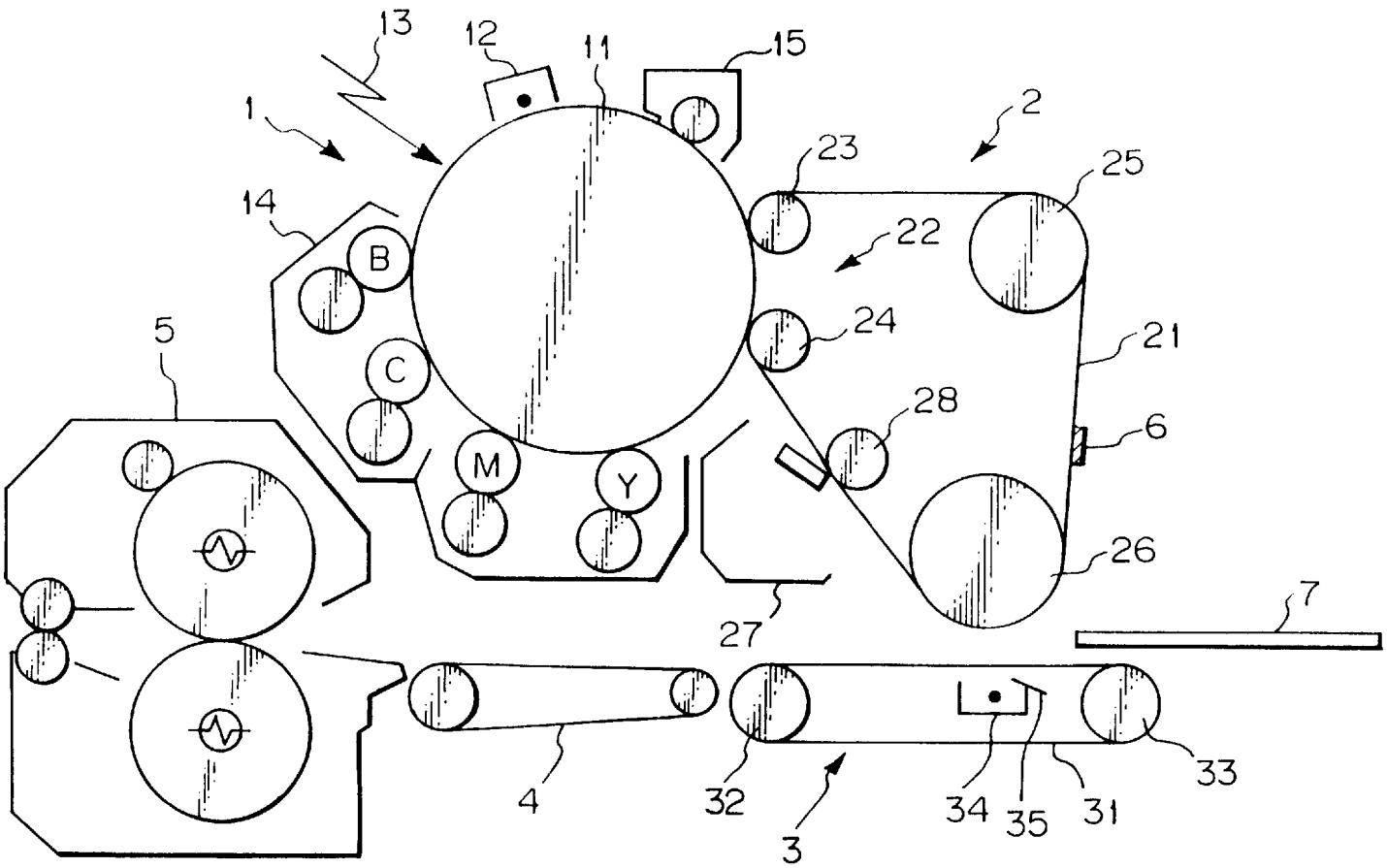
FIG. 2 shows a first embodiment of the image forming apparatus in accordance with the present invention.

Specifically, as shown in FIG. 2, the image forming apparatus has an image forming unit 1, a primary transfer unit 2, a secondary transfer unit 3, a transport unit 4, and a fixing unit 5. The image forming unit has a charger 12, an exposing section represented by a laser beam 13, a color developing section 14 and a drum cleaner 15 which are arranged around a photoconductive element 11. In the illustrative embodiment, the photoconductive element 11 is implemented as a drum. The exposing section scans the drum 11 with the laser beam 13. The color developing section 14 consists of yellow (Y), magenta (M), cyan (C) and black (B) developing portions.

Figure 3:
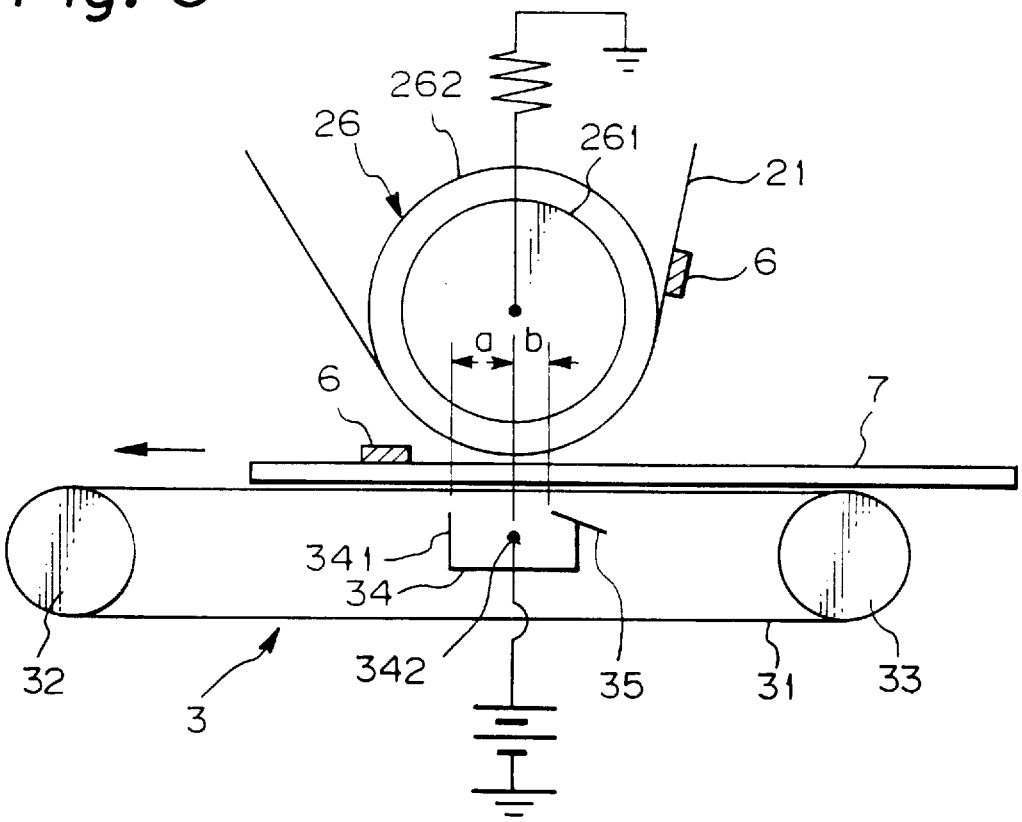
FIG. 3 shows a secondary transfer section included in the embodiment.

The primary transfer unit 2 has an intermediate transfer belt 21, a primary transfer section 22 consisting of a bias roller 23 and a ground roller 24, a tension roller 25, a secondary transfer roller 26, a belt cleaner 27, and a roller 28 facing the belt cleaner 27. The belt 21 is formed of a material having a medium resistance of $1\times10^{7}$ Ω to $1\times10^{13}$ Ω, and is passed over the ground roller 24, bias roller 23, tension roller 25, secondary transfer roller 26, and roller 28. As shown in FIG. 3, the roller 26 contacting the inner periphery of the belt 21 consists of a metallic roller or core 261 and a 0.3 mm thick hydrine rubber layer 262 covering the core 261. The roller 26 has a surface resistance ranging from about $1\times10^7$ Ω to about $1\times10^9$ Ω. A moving mechanism, not shown, releases the belt 21 from the drum 11 except when a toner image should be transferred from the drum 11 to the belt 21 (primary transfer).

Referring again to FIG. 2, the secondary transfer unit 3 has a secondary transfer belt 31 passed over a drive roller 32 and a driven roller 33, and a corona charger or bias applying means 34 facing the inner periphery of the belt 31. The belt 31 is formed of a material having a medium surface resistance of $1\times10^7$ Ω to $1\times10^{13}$ Ω. As shown in FIG. 3, the corona charger 34 has a casing 341 accommodating a charge wire 342 therein, and faces the secondary transfer roller 26. An inlet seal member 35 is mounted on the casing 342 at the upstream side of the belt 31 in order to limit the charging width of the charger 34. The inlet seal member 35 is formed of polyethylene terephthalate (PET) or a similar insulation type resin. As shown in FIG. 3, assume a line connecting the center of the secondary transfer roller 26 and that of the charge wire 342, and assume that the corona charger 34 has an upstream charging width b and a downstream charging width a with respect to the above line. Then, the seal member 35 is so positioned as to set up a relation of a>b. A moving mechanism, not shown, releases the secondary transfer unit 3 from the intermediate transfer belt 21 except when a toner image should be transferred from the belt 21 to a paper or similar recording medium 7 (secondary transfer).

Assume that the above apparatus is operated in a full-color mode. Then, the charger 12 charges the surface of the drum 11 uniformly. The laser beam 13 scans the charged surface of the drum 11 in accordance with image data so as to electrostatically form a latent image on the drum 11. The color developing section 14 develops the latent image with any one of Y, M, C and B toner. After the resulting toner image has been transferred from the drum 11 to the intermediate transfer belt 21, the drum 11 is cleaned by the drum cleaner 15.

At the time of the primary transfer, the intermediate transfer belt 21 is brought into contact with the drum 11. In this condition, the primary transfer section 22 deposits a charge indirectly on the toner image, causing the primary transfer of the toner image to occur. Specifically, to transfer the first toner image, i.e., Y, M, C or B toner image from the drum 11 to the belt 21, the belt 21 is caused to contact the drum 11 by the moving means, not shown. After the primary transfer of the first toner image, the belt 21 is moved away from the drum 11. After the belt 21 has been rotated such that the first toner image existing thereon will be brought into accurate register with the second toner image, it is caused to contact the belt 21 again. Then, the second toner image is transferred from the drum 11 to the belt 21 over the first toner image. Such primary transfer is repeated until all of the Y, M, C and B toner images have been transferred from the drum 11 to the belt 21 in accurate register. The resulting full-color image 6 is transferred from the belt 21 to the paper 7 conveyed to the secondary transfer unit 3 (secondary transfer).

Figure 4:
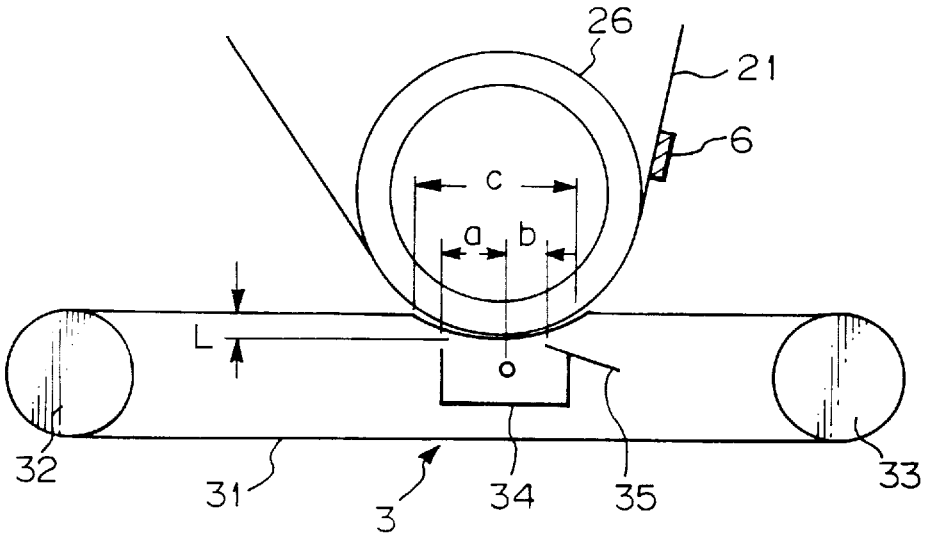
FIG. 4 is a view demonstrating the operation of the secondary transfer section shown in FIG. 3.

For the secondary transfer of the full-color image 6, the secondary transfer unit 3 is moved toward the secondary transfer roller 26 by moving means, not shown. As a result, as shown in FIG. 4, the secondary transfer belt 31 is brought into contact with the portion of the intermediate transfer belt 21 contacting the secondary transfer roller 26. While the corona charger 34 applies a bias for the secondary transfer, the full-color image 6 is transferred from the belt 21 to the paper 7 conveyed to the nip between the belts 21 and 31. In this condition, as shown in FIG. 4, the belt 31 deforms complementarily to the shape of the roller 26 and forms a nip having a width c. The nip width c is determined by an amount of bite L. The belt 31 is pressed against the belt 21 by a uniform pressure over the range of the nip width c. This prevents an excessive pressure from acting locally on the toner forming the toner image 6 on the belt 21, and thereby prevents the parting ability of the toner image 6 and the surface of the belt 21 from being lowered. Therefore, the toner image transferred form the belt 21 to the paper 7 is free from local or vermicular omission.

Because the secondary transfer belt 31 deforms complementarily to the shape of the secondary transfer roller 26, the air gap at the upstream side of the nip is reduced. This, in turn, reduces electric lines of force (electric field) generated around the nip by the transfer bias and thereby obviates the scattering of toner.

The inlet seal member 35 limits the charging width of the corona charger 34 such that the upstream width b is smaller than the downstream width a, as stated earlier with reference to FIG. 3. This is also successful to prevent the toner from being scattered around at the upstream side of the nip.

Further, as shown in FIG. 4, the nip width c for the secondary transfer is selected to be larger than the charging width (a+b) of the corona charger 34. As a result, the electric lines of force (electric field) generated around the nip due to the transfer bias are further reduced. This reduces the scattering of the toner and allows a desirable image to be transferred to the paper 7.

2nd Embodiment

The general arrangement of this embodiment will be outlined first. The embodiment is also generally made up of the image forming unit, primary transfer unit, secondary transfer unit, and fixing unit. In the illustrative embodiment, the primary transfer unit has two secondary transfer rollers in addition to the intermediate transfer belt and primary transfer section. The two secondary transfer rollers are spaced from each other in the direction in which the recording medium is conveyed.

The secondary transfer unit has a ground roller in addition to the secondary transfer belt and bias applying means facing the inner periphery of the belt. The ground roller also faces the inner periphery of the belt. At the time of the secondary transfer, the secondary transfer belt is pressed against the portion of the intermediate transfer belt between the two secondary transfer rollers of the primary transfer unit, so that the former belt contacts the latter belt over a relatively broad area. This reduces the pressure acting between the secondary transfer belt and the intermediate transfer belt, and thereby prevents an excessive pressure from acting on toner forming a toner image on the intermediate transfer belt.

The ground roller included in the secondary transfer unit faces the intermediate between the two secondary transfer rollers of the primary transfer unit via the secondary transfer belt. The bias applying means is positioned downstream, in the direction of paper transport, of the downstream one of the two secondary transfer rollers. At the time of the secondary transfer, the upstream portion, with respect to the ground roller, of the area where the two belts contact each other and the downstream portion of the same area define a non-transfer region and a transfer region, respectively. This successfully reduces electric lines of force (electric field) at the region upstream of the contact region, and thereby obviates the scattering of the toner.

Further, at the time of the secondary transfer, the secondary transfer belt is pressed against the intermediate transfer belt, preventing an air gap from being formed between the two belts. While the secondary transfer is not effected, the secondary transfer belt is released from the intermediate transfer belt. This obviates a defective image when toner images of different colors are transferred to the intermediate belt one above the other.

Figure 5:
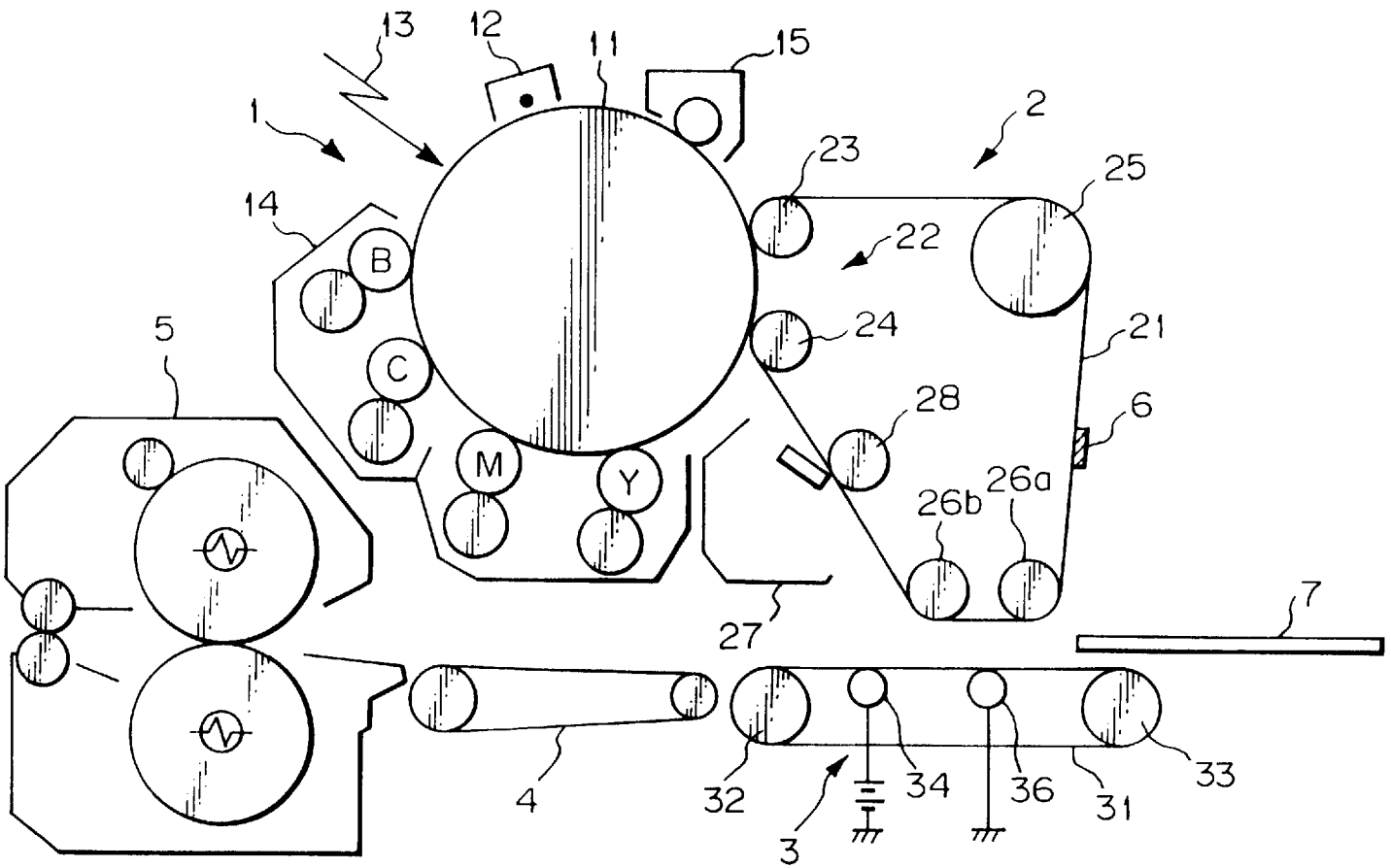
FIG. 5 shows a second embodiment of the present invention.

Specifically, as shown in FIG. 5, the second embodiment also has the image forming unit 1, primary transfer unit 2, secondary transfer unit 3, transport unit 4, and fixing unit 5. The image forming unit has the main charger 12, exposing section represented by the laser beam 13, color developing section 14 and drum cleaner 15 arranged around the drum 11, as in the first embodiment.

The primary transfer unit 2 has two secondary transfer rollers 26*a* and 26*b* in addition to the intermediate transfer belt 21, primary transfer section 22 consisting of the bias roller 23 and ground roller 24, tension roller 25, belt cleaner 27, and roller 28 facing the belt cleaner 27. Again, the belt 21 is formed of a material having a medium resistance of $1\times10^{7}$ Ω to $1\times10^{13}$ Ω, and is passed over the ground roller 24, bias roller 23, tension roller 25, secondary transfer rollers 26*a* and 26*b*, and roller 28. The moving mechanism, not shown, releases the belt 21 from the drum 11 except when a toner image should be transferred from the drum 11 to the belt 21 (primary transfer).

Figure 6:
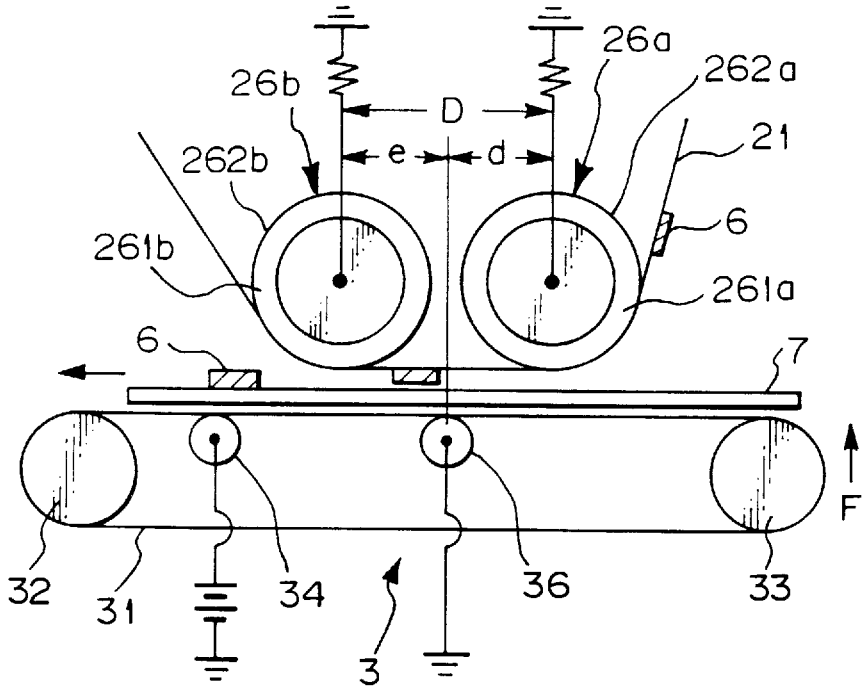
FIG. 6 shows a secondary transfer section included in the second embodiment.

As shown in FIG. 6, the rollers 26*a* and 26*b* contacting the inner periphery of the belt 21 respectively consist of metallic rollers or cores 261*a* and 261*b* and 0.3 mm thick hydrine rubber layers 262*a* and 262*b* covering the cores 261*a* and 261*b*. The rollers 26*a* and 26*b* each have a surface resistance ranging from about $1\times10^{7}$ Ω to about $1\times10^{9}$ Ω. The rollers 26*a* and 26*b* are spaced by a preselected distance D in the direction of paper transport.

Figure 7:
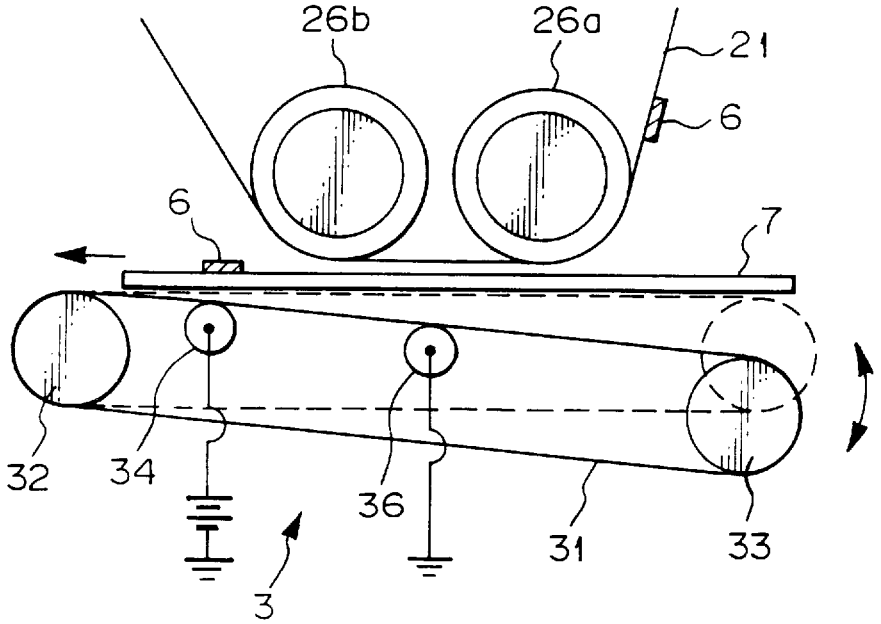
FIG. 7 is a view demonstrating the operation of the secondary transfer section of FIG. 6.

Referring again to FIG. 5, the secondary transfer unit 3 has a ground roller 36 in addition to the secondary transfer belt 31 passed over the drive roller 32 and driven roller 33, and bias applying means 34 facing the inner periphery of the belt 31. The ground roller 36 also faces the inner periphery of the belt 31. The belt 31 is also formed of a material having a medium surface resistance of $1\times10^{7}$ Ω to $1\times10^{13}$ Ω). The ground roller 36 faces the intermediate between the two secondary transfer rollers 26*a* and 26*b* of the primary transfer unit 2 with the intermediary of the secondary transfer belt 31. The bias applying means 34 is positioned downstream, in the direction of paper transport, of the downstream one 26*b* of the two secondary transfer rollers 26*a* and 26*b*. As shown in FIG. 7, the secondary transfer unit 3 is bodily rotatable about the drive roller 32 toward and away from the primary transfer unit 2. The belt 31 is pressed against the belt 21 during the secondary transfer, or released from the belt 21 while the secondary transfer is not effected.

The operation of this embodiment is identical with the first embodiment except for the following. When the full-color toner image 6 is to be transferred from the intermediate transfer belt 21 to the paper 7 (secondary transfer), the secondary transfer unit 3 is bodily rotated about the roller 32 toward the primary transfer unit 2. As a result, as shown in FIG. 6, the secondary transfer belt 31 is pressed against the portion of the intermediate belt 21 between the secondary transfer rollers 26*a* and 26*b*. While the bias applying means 34 applies a preselected bias for the secondary transfer, the toner image 6 is transferred from the belt 21 to the paper 7. It is noteworthy that the belt 31 is rotated about the roller 32 into contact with the portion of the belt 21 between the secondary transfer rollers 26*a* and 26*b*, and can therefore be pressed against the belt 21 by a small force F, FIG. 6. Moreover, because the two belts 31 and 21 contact each other over a relatively broad area, there can be reduced the pressure to act between the belts 31 and 21. This successfully prevents an excessive force from acting on the toner forming the toner image 6 on the belt 21, and thereby insures the parting ability between the toner image 6 and the surface of the belt 21. The resulting toner image transferred to the paper 7 is free from vermicular omission.

The ground roller 36 faces the intermediate between the two secondary transfer rollers 26*a* and 26*b* of the primary transfer unit 2 with the intermediary of the secondary transfer belt 31. The bias applying means 34 is positioned downstream, in the direction of paper transport, of the downstream one 26*b* of the two secondary transfer rollers 26*a* and 26*b*. At the time of the secondary transfer, the upstream portion d, with respect to the ground roller, of the area where the two belts 31 and 21 contact each other and the downstream portion e of the same area can define a non-transfer region and a transfer region, respectively. Because the belts 31 and 21 nipping the paper 7 therebetween run substantially in parallel with and at the same speed as each other, the secondary transfer can be effected without any air gap between the belts 31 and 21. This successfully reduces the electric lines of force (electric field) generated by the transfer bias at the region upstream of the secondary transfer roller 26*a*, and thereby obviates the scattering of the toner. The resulting image on the paper 7 is stable and free from blurring.

While the secondary transfer is not effected, the secondary transfer belt 31 is released from the intermediate transfer belt 21. This obviates a defective image when toner images of different colors are transferred to the intermediate belt 21 one above the other.

3rd Embodiment

As for the general construction, this embodiment is similar to the second embodiment except for the following. The secondary transfer unit includes cleaning means in addition to the secondary transfer belt, bias applying means in the form of a bias roller, and ground roller. The ground roller has its surface formed of a conductive foam material. When the secondary transfer belt is pressed against the intermediate transfer belt, the ground roller urges the secondary transfer belt against the secondary transfer roller via the intermediate belt with a low linear pressure because it is elastic. This reduces the pressure to act on the toner existing on the intermediate transfer belt.

In the illustrative embodiment, the ground roller faces an upstream one of the two secondary transfer rollers of the primary transfer unit via the secondary transfer belt. The bias applying roller is positioned downstream of the downstream secondary transfer roller in the direction of paper transport. This reduces, during the secondary transfer, the electric lines of force (electric field) at the portion upstream of the ground roller, and thereby frees the toner image from blurring ascribable to the scattering of toner.

The cleaning means additionally included in the secondary transfer unit removes the toner impurities deposited on the surface of the bias applying means during the secondary transfer. As a result, the bias applying roller has its surface maintained smooth at all times and can contact the entire secondary transfer belt evenly with a uniform force.

The ground roller may be replaced with a brush member having a conductive elastic brush at its end, if desired. The brush will urge the secondary transfer belt against the intermediate transfer belt due to its elasticity. This also insures the stable contact of the secondary transfer belt with the intermediate transfer belt under a low linear pressure.

Figure 8:
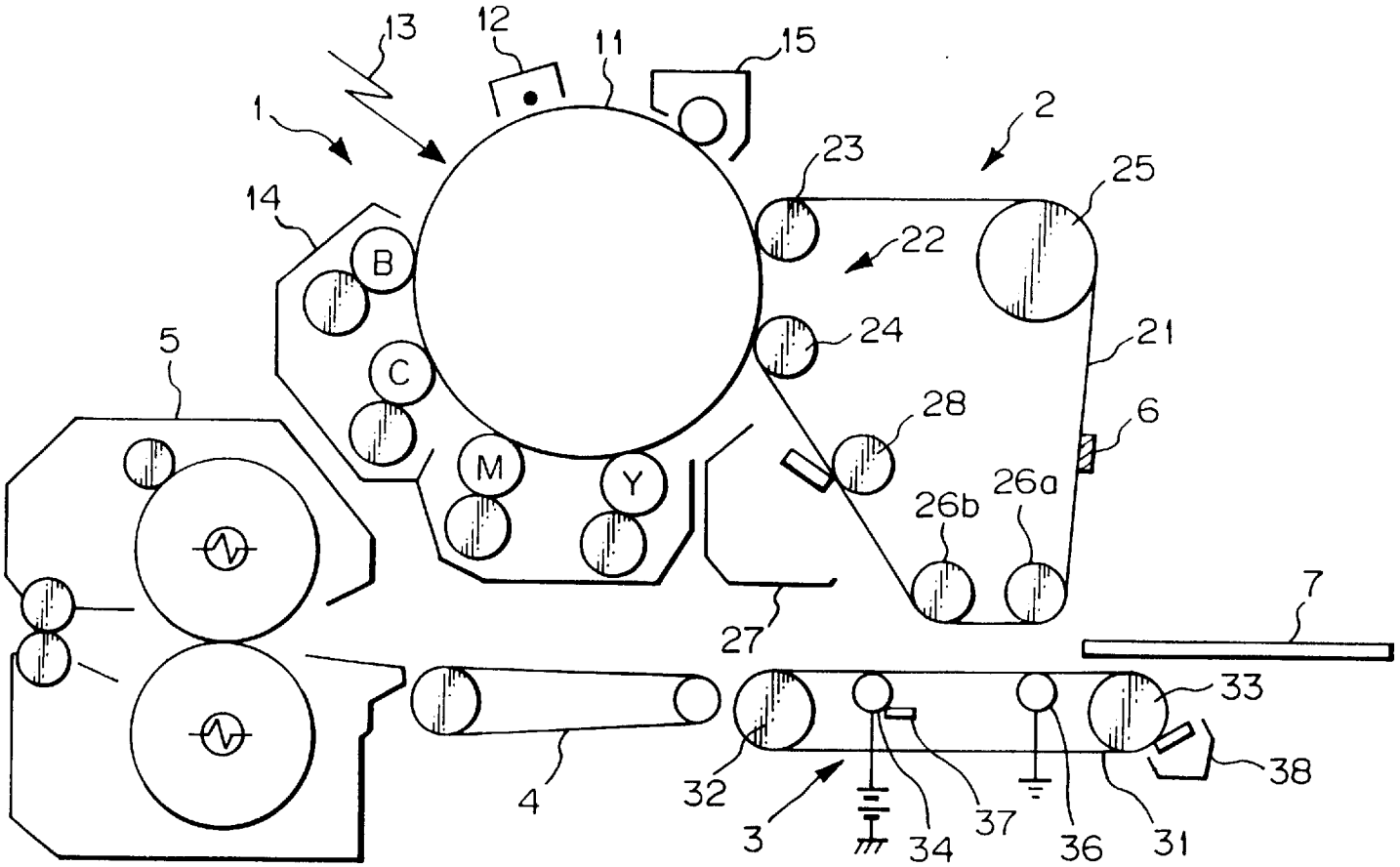
FIG. 8 shows a third embodiment of the present invention.
Figure 9:
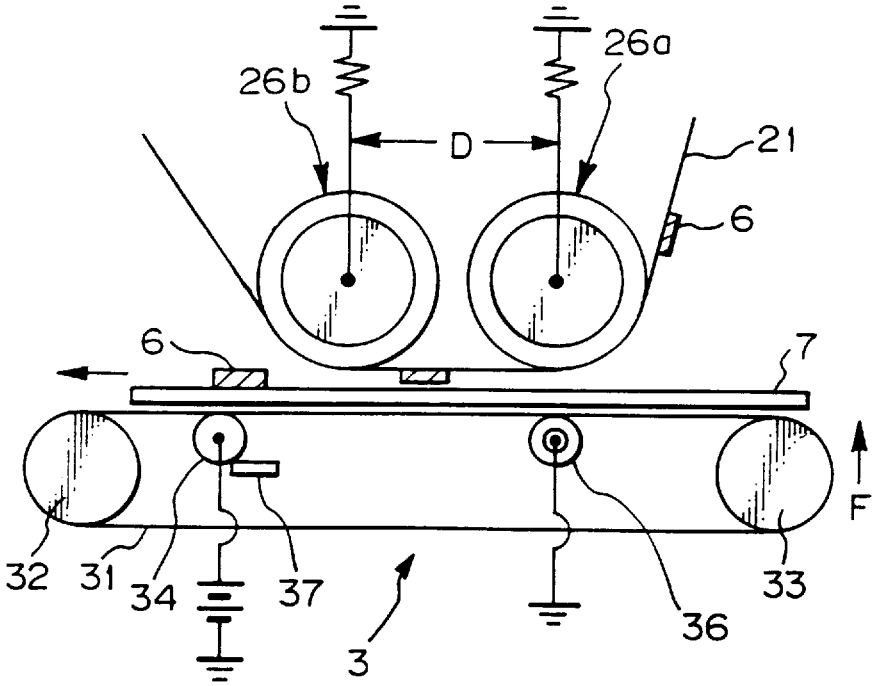
FIG. 9 shows a secondary transfer section included in the third embodiment.
Figure 10:
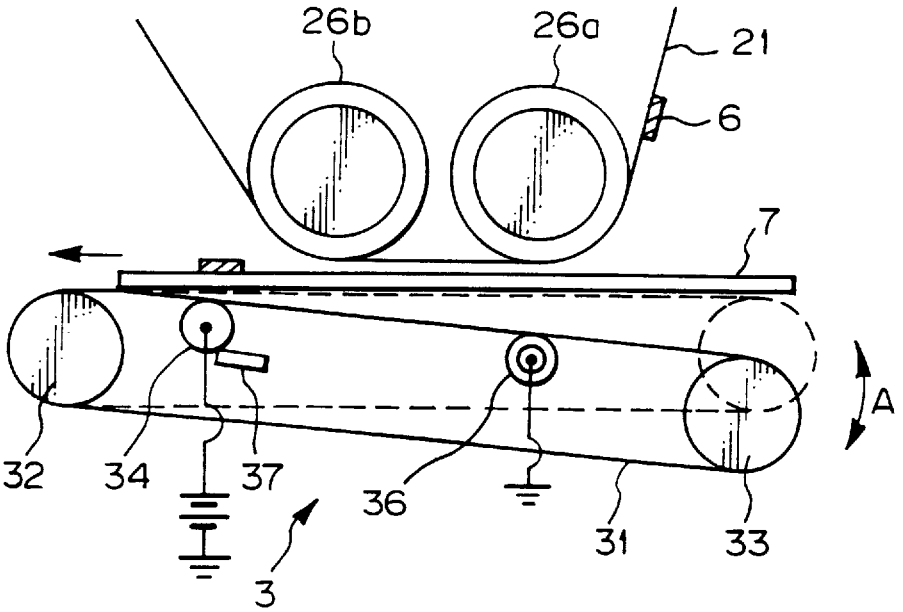
FIG. 10 is a view demonstrating the operation of the secondary transfer, section shown in FIG. 9.

FIGS. 8, 9 and 10 show the construction of this embodiment specifically. The construction of this embodiment is similar to that of the second embodiment except for the following. As shown, the secondary transfer unit 3 includes cleaning means 37 in addition to the secondary transfer belt 31 passed over the rollers 32 and 33, bias applying roller 34, and ground roller 36. A belt cleaner 38 adjoins the outer surface of the belt 31. The roller or bias applying means 34 faces the inner periphery of the belt 31 at a position downstream of the secondary transfer roller 26*b* located downstream of the other secondary transfer roller 26*b*. The ground roller 36 faces the upstream secondary transfer roller 26*a* with the intermediary of the belt 31. The ground roller 36 has its surface formed of a conductive foam material, so that it presses the paper 7 with a linear pressure one. The cleaning means 37 cleans the surface of the bias roller 34 and may be implemented as a blade or a brush roller by way of example. If desired, a voltage opposite in polarity to the voltage to be applied to the bias roller 34 may be applied to the cleaning means 37 in order to enhance the removal of toner and impurities from the surface of the roller 34.

The secondary transfer unit 3 is bodily rotatable about the drive roller 32 toward and away from the primary transfer unit 2, as indicated by an arrow A in FIG. 10. The secondary transfer belt 31 is brought into contact with the intermediate transfer belt 21 during the secondary image transfer, or released from the belt 21 while the secondary image transfer is not effected.

The operation of this embodiment is also identical with the first embodiment except for the following. When the full-color toner image 6 is to be transferred from the intermediate transfer belt 21 to the paper 7 (secondary transfer), the secondary transfer unit 3 is bodily rotated about the roller 32 toward the primary transfer unit 2, as in the second embodiment. As a result, as shown in FIG. 9, the secondary transfer belt 31 is pressed against the portion of the intermediate belt 21 between the secondary transfer rollers 26*a* and 26*b*. While the bias roller 34 applies a preselected bias for the secondary transfer, the toner image 6 is transferred from the belt 21 to the paper 7. It is noteworthy that the belt 31 is rotated about the roller 32 into contact with the portion of the belt 21 between the two rollers 26*a* and 26*b*, and can therefore be pressed against the belt 21 by a small force F. Further, because the two belts 31 and 21 contact each other over a relatively broad area, there can be reduced the pressure to act between the belts 31 and 21.

Figure 11:
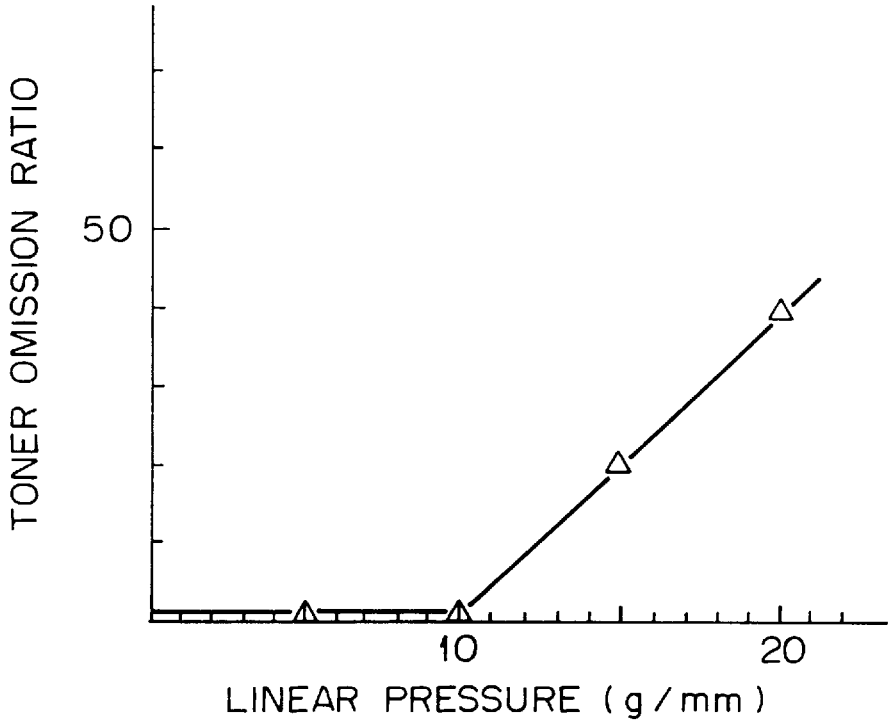
FIG. 11 a graph showing a relation between the linear pressure of a ground roller and the omission ratio of a toner image.

The ground roller 36 whose surface is formed of a conductive foam material urges the belt 31 against the belt 21 at the position facing the roller 26*a*, exerting a linear pressure as low as, e.g., 10 g/mm or below. This successfully reduces the pressure to act on the toner image 6 existing on the intermediate transfer belt 21, and thereby insures the parting ability between the toner image 6 and the surface of the belt 21. FIG. 11 is a graph showing a relation between the linear pressure exerted by the ground roller 36 and the toner omission ratio. As shown, the illustrative embodiment reduces the toner omission ratio to a noticeable degree. It follows that the toner image transferred to the paper 7 is surely free from vermicular local omission. It is to be noted that the linear pressure shown in FIG. 11 is produced by dividing the total load of the ground roller 36 acting on the secondary transfer roller 26*a* by the length over which the rollers 36 and 26*a* contact each other.

The ground roller 36 faces the upstream secondary transfer rollers 26*a* of the primary transfer unit 2 with the intermediary of the secondary transfer belt 31. This, coupled with the fact that the bias roller 34 is positioned downstream, in the direction of paper transport, of the downstream secondary transfer roller 26*b*, allows the secondary transfer to be effected without any air gap between the belts 31 and 21. Further, because the ground roller 36 contacts the portion of the belt 21 capable of contacting the belt 31, the electric lines of force (electric field) generated by the transfer bias at the region upstream of the secondary transfer roller 26*a* can be reduced. This obviates the scattering of the toner and frees the resulting image on the paper 7 from blurring.

While the secondary transfer is not effected, the secondary transfer belt 31 is released from the intermediate transfer belt 21. This obviates a defective image when toner images of different colors are transferred to the intermediate belt 21 one above the other.

Moreover, during the secondary transfer, the cleaning means 37 removes the toner and impurities from the surface of the bias roller 34. As a result, the bias roller has 34 its surface maintained smooth and can contact the entire secondary transfer belt 31 evenly with a uniform force, insuring desirable toner images.

Figure 12:
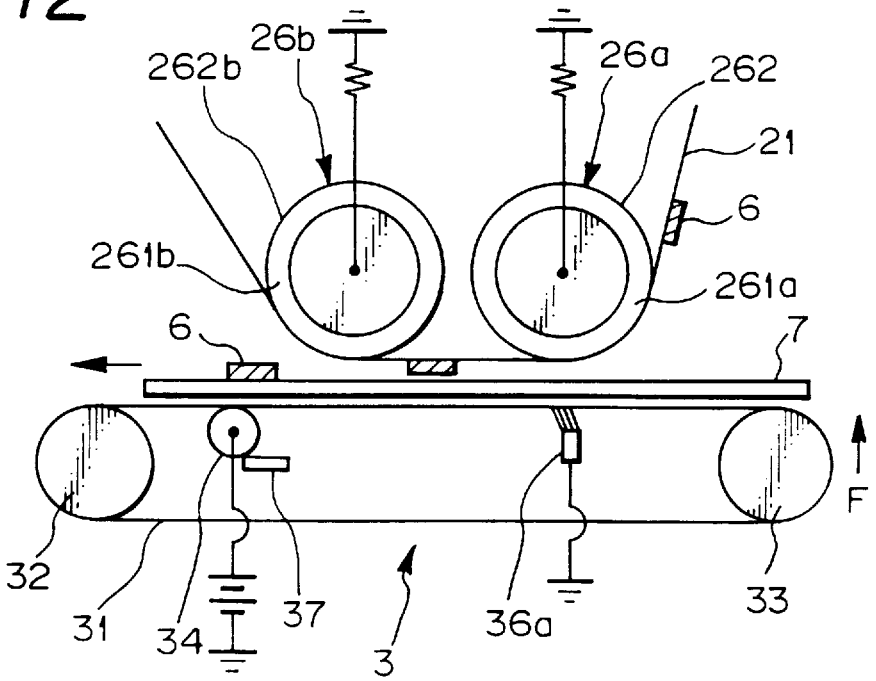
FIG. 12 shows a modification of the third embodiment.

FIG. 12 shows a modification of the third embodiment. As shown, the ground roller 36 is replaced with a conductive brush member 36*a* having a conductive elastic brush at its end. The brush will urge the secondary transfer belt 31 against the intermediate transfer belt 21 elastically, i.e., with a low linear pressure stably.

4th Embodiment

The general construction of this embodiment is similar to that of the second embodiment except for the following. In this embodiment, the intermediate transfer belt included in the primary transfer unit is formed of a material having a medium resistance ranging from $10^8$ Ωcm to $10^{10}$ Ωcm. With such a resistance, the intermediate transfer belt enhances image transfer and eliminates the need for a device for discharging it. In the illustrative embodiment, the bias applying means included in the secondary transfer unit is implemented as a conductive brush. The secondary transfer unit additionally includes discharging means facing the ground roller with the intermediary of the secondary transfer belt.

The bias applying means faces the downstream one of the two secondary transfer rollers or the downstream portion between the two secondary rollers. The secondary transfer belt is formed of an insulating material having a volume resistivity of $10^{11}$ Ωcm or above. During the secondary transfer, the secondary transfer belt with such a volume resistivity reduces the electric lines of force (electric field) generated at the portion upstream of the upstream secondary transfer roller by the transfer bias applied to the intermediate transfer belt. As a result, the toner is prevented from being scattered around and depositing on the recording medium. In addition, the secondary transfer belt with the above volume resistivity can have its resistance distribution stabilized, insuring images free from irregularity ascribable to irregular transfer.

The discharging means included in the secondary transfer unit cooperates with the ground roller to dissipate the charge deposited on the secondary transfer belt by the bias applying means, thereby initializing the secondary transfer belt. This allows the bias to be applied by the bias applying means constant when images are continuously formed on consecutive recording media. The bias applying means is implemented as a conductive brush or a conductive roller in order to obviate ozone.

Figure 13:
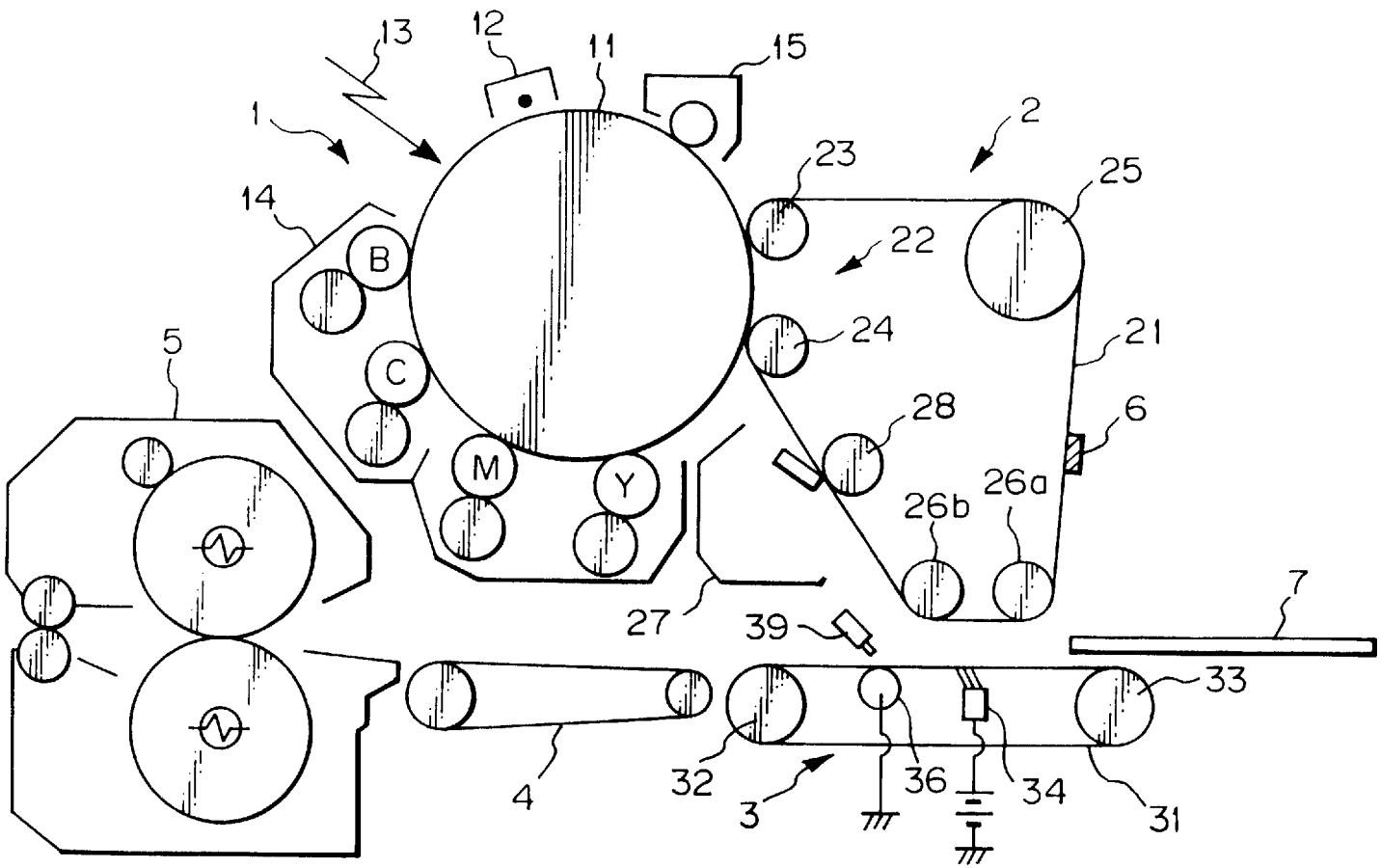
FIG. 13 shows a fourth embodiment of the present invention.
Figure 14:
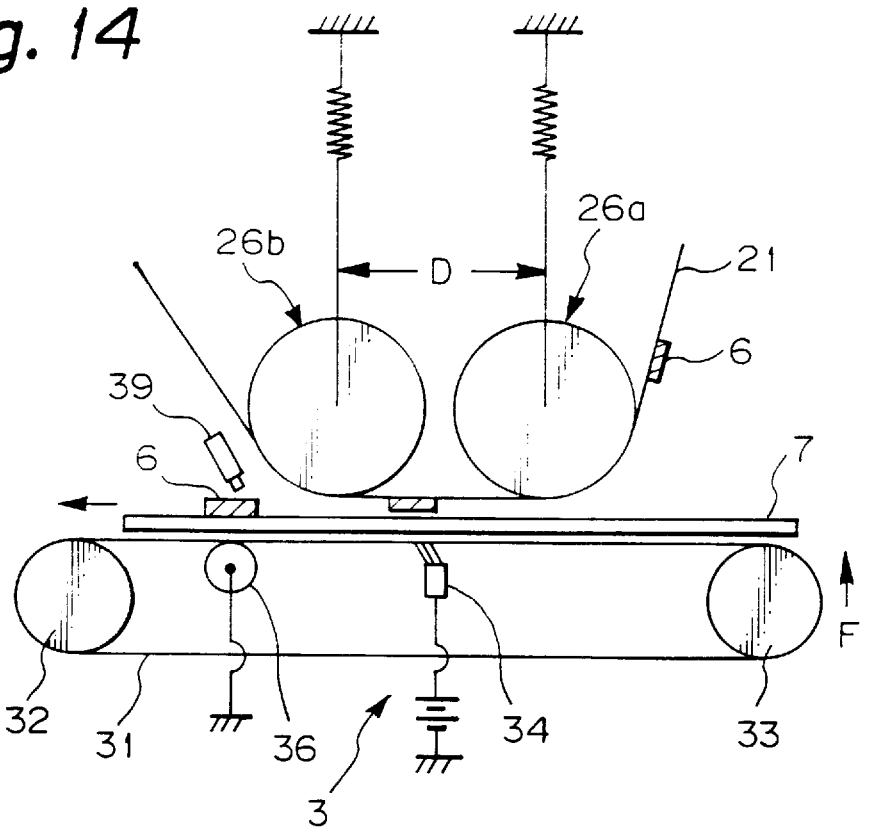
FIG. 14 shows a secondary transfer section included in the fourth embodiment.
Figure 15:
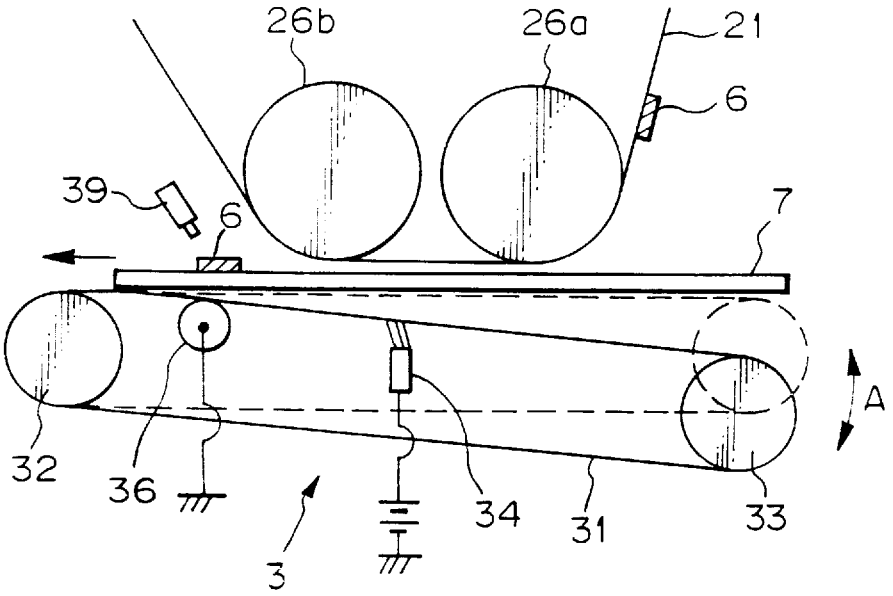
FIG. 15 is is a view demonstrating the operation of the fourth embodiment.

FIGS. 13, 14 and 15 show the construction of this embodiment specifically. The construction is essentially similar to that of the second embodiment except for the following. In this embodiment, the intermediate transfer belt 21 is formed of a material having a medium volume resistance of $10^8$ Ωcm to $10^{10}$ Ωcm, e.g., ethylene tetrafluoroethylene. As shown in FIG. 14, the two secondary transfer rollers 26*a* and 26*b* are spaced by the distance D from each other in the direction of paper transport.

The bias applying means 34 included in the secondary transfer unit 3 is implemented as a conductive brush. Discharging means 39 faces the ground roller 36 with the intermediary of the secondary transfer belt 31. In the illustrative embodiment, the transfer belt 31 is formed of an insulating saturated polyester having a volume resistivity of $10^{11}$ Ωcm or above, e.g., Lumilar or Mylar. The conductive brush 34 is located to face the downstream secondary transfer roller 26*b* or the downstream side between the two rollers 26*a* and 26*b*.

The secondary transfer unit 3 is bodily rotatable about the drive roller 32 toward and away from the primary transfer unit 2, as indicated by an arrow A in FIG. 14. The secondary transfer belt 31 is brought into contact with the intermediate transfer belt 21 during the secondary transfer, or released from the belt 21 while the secondary transfer is not effected.

This embodiment forms a full-color image on the paper 7 in the same manner as the second embodiment except for the following. During the primary transfer, the charge deposited on the intermediate transfer belt 21 by primary transfer section 22 can be substantially uniformly distributed because the belt 21 has the volume resistivity ranging from $10^8$ Ωcm to $10^{10}$ Ωcm, as stated earlier. The uniform charge distribution enhances desirable image transfer. In addition, a device for discharging the belt 21 is not necessary because such a belt 21 can be easily discharged by the ground roller 24. Volume resistivities lower than $10^8$ Ωcm would prevent the toner image from being transferred to the belt 21 while volume resistivities higher than $10^{10}$ Ωcm would result in the need for an extra discharging device in addition to the ground roller 24.

For the secondary transfer of the full-color image 6, the secondary transfer unit 3 is bodily rotated about the drive roller 32 toward the secondary transfer roller 26. As a result, as shown in FIG. 14, the secondary transfer belt 31 is pressed against the portion of the intermediate belt 21 between the secondary transfer rollers 26*a* and 26*b*. While the brush or bias applying means 34 applies a preselected bias to the paper 7, the toner image 6 is transferred from the belt 21 to the paper 7. It is noteworthy that the belt 31 is rotated about the roller 32 into contact with the portion of the belt 21 between the two rollers 26*a* and 26*b*, and can therefore be pressed against the belt 21 by a small force F. Moreover, because the two belts 31 and 21 contact each other over a relatively broad area, there can be reduced the pressure to act between the belts 31 and 21. This successfully prevents an excessive force from acting on the toner forming the toner image 6 on the belt 21, and thereby insures the parting ability between the toner image 6 and the surface of the belt 21. The resulting toner image transferred to the paper 7 is free from vermicular omission.

The brush 34 faces the downstream secondary transfer roller 26*b* or the downstream side between the two rollers 26*a* and 26*b*. This, coupled with the fact that the secondary transfer belt 31 has the volume resistivity as high as $10^{11}$ Ωcm or above, successfully reduces the electric lines of force (electric field) generated by the transfer bias applied to the belt 21 during the secondary transfer at the region upstream of the secondary transfer roller 26*a*, and thereby obviates the scattering of the toner. The resulting image on the paper 7 is stable and free from blurring.

Because the secondary transfer belt 31 has a volume resistivity as high as $10^{11}$ Ωcm, its resistance distribution is stable enough to free images from irregularity as to the transfer. Should the volume resistivity be lower than $10^{11}$ Ωcm, some irregularity in resistance would occur in the circumferential direction and thrust direction of the belt 31 and would render the tonality of the image irregular due to irregular image transfer.

The discharging means 39 and ground roller 36 dissipate the charge deposited on the secondary transfer belt 31 by the brush 34, initializing the potential of the belt 31 at all times. Therefore, when images are continuously formed on consecutive papers 7, the bias applied by the brush 34 can be maintained constant. This not only stabilizes image quality, but also reduces the size of a power source for driving the brush 34. If desired, the drive roller 32 may play the role of the ground roller 36 at the same time, in which case the discharging means 39 will be located to face the drive roller 32.

The brush or bias applying means 34 solves the ozone problem. The brush 34 may be replaced with a conductive roller, if desired.

While the secondary transfer is not effected, the secondary transfer belt 31 is released from the intermediate transfer belt 21. This obviates a defective image when toner images of different colors are transferred to the intermediate belt 21 one above the other.

Figure 16:
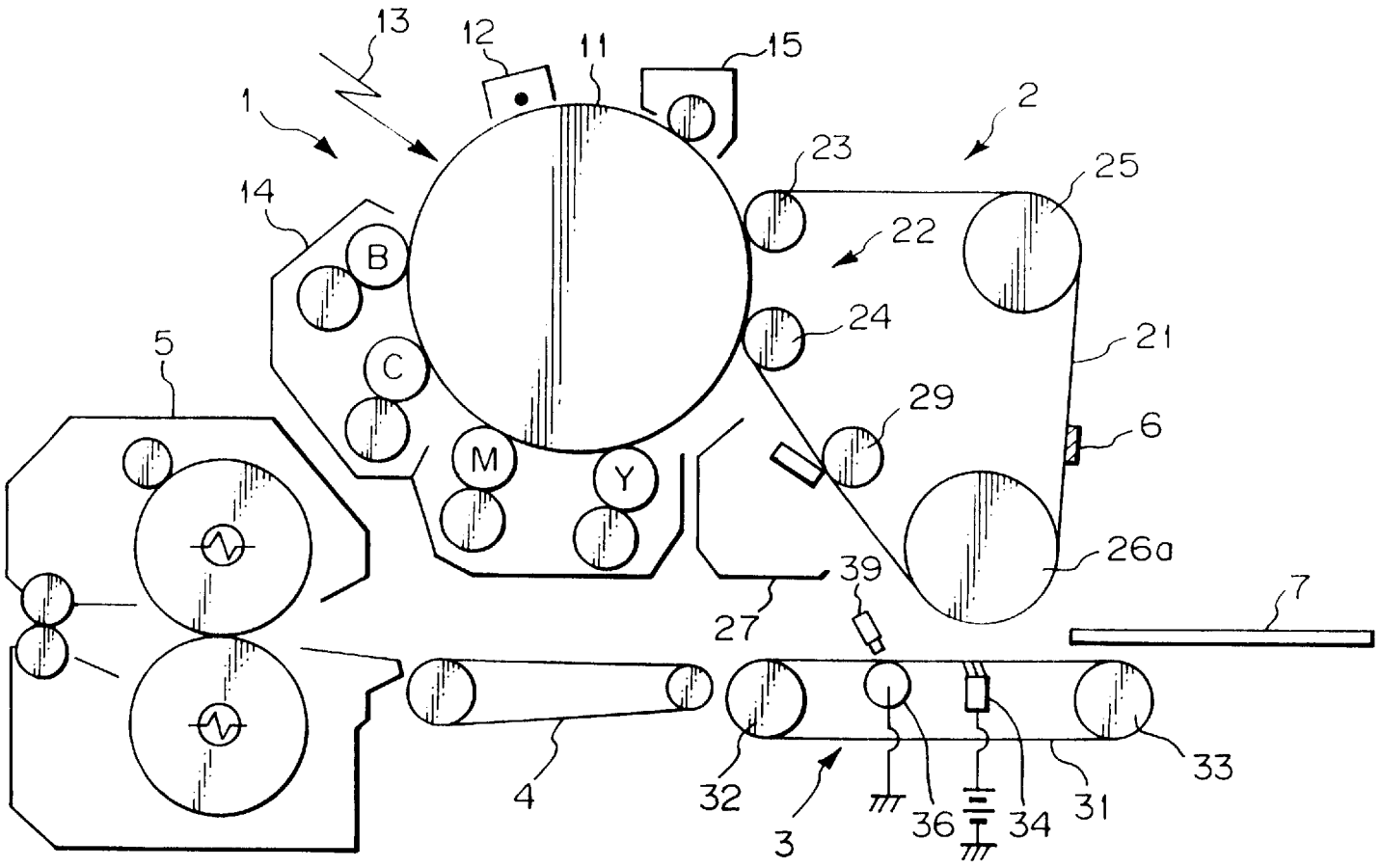
FIG. 16 shows a modification of the fourth embodiment.

As shown in FIG. 16, the bias applying means in the form of the conductive brush 34 may be applied to the construction of the first embodiment including a single secondary transfer roller, labeled 26*a* in FIG. 16.

Various modifications will become possible for those skilled in the art after receiving the teachings of the present disclosure without departing from the scope thereof.

What is claimed is:

1. An image forming apparatus comprising:

a primary transfer unit including a primary transfer section for sequentially transferring toner images of different colors from a photoconductive element to an intermediate transfer belt having a medium resistance to thereby form a composite color image on said intermediate transfer belt, and a secondary transfer roller facing an inner periphery of said intermediate transfer belt for causing said intermediate transfer belt to contact a recording medium; and a secondary transfer unit for transferring the composite toner image from said intermediate transfer belt to the recording medium;

wherein said secondary transfer unit includes a secondary transfer belt having a medium resistance, and bias applying means facing said secondary transfer roller with said secondary transfer belt being an intermediary; and wherein on transfer of the composite toner image from the intermediate transfer belt to the recording medium the secondary transfer belt deforms to a shape of the secondary transfer roller.

2. An apparatus as claimed in claim 1, wherein said bias applying means comprises a corona charger.

3. An apparatus as claimed in claim 2, wherein said bias applying means further comprises an inlet seal member positioned at an upstream side with respect to said secondary transfer belt to limit a charging width of the corona charger.

4. An image forming apparatus comprising:

a primary transfer unit for sequentially transferring toner images of different colors from a photoconductive element to an intermediate transfer belt having a medium resistance to thereby form a composite color image on said intermediate transfer belt, said primary transfer unit including two secondary transfer rollers facing an inner periphery of said intermediate transfer belt and spaced by a preselected distance in a direction of transport in which a recording medium is conveyed; and a secondary transfer unit for transferring the composite toner image from said intermediate transfer belt to the recording medium, and including a secondary transfer belt having a medium resistance, a ground roller, and bias applying means;

wherein said secondary transfer belt extends in the direction of transport, wherein said ground roller faces a portion of an inner periphery of said secondary transfer belt facing the intermediate transfer belt between said two secondary transfer rollers, and wherein said bias applying means faces the inner periphery of said secondary transfer belt at a position downstream of the downstream one of said two secondary transfer rollers with respect to the direction of transport.

5. An apparatus as claimed in claim 4, wherein said secondary transfer belt is capable of contacting a portion of said intermediate transfer belt extending between said two secondary transfer rollers, and wherein said secondary transfer belt forms, when contacting said portion of said intermediate transfer belt, a non-transfer region upstream of said ground roller and a transfer region downstream of said ground roller.

6. An apparatus as claimed in claim 4, wherein said secondary transfer belt contacts said intermediate transfer belt only during secondary image transfer from said intermediate transfer belt to the recording medium.

7. An image forming apparatus comprising:

a primary transfer unit for sequentially transferring toner images of different colors from a photoconductive element to an intermediate transfer belt having a medium resistance to thereby form a composite color image on said intermediate transfer belt, said primary transfer unit including two secondary transfer rollers facing an inner periphery of said intermediate transfer belt and spaced by a preselected distance in a direction of transport in which a recording medium is conveyed; and a secondary transfer unit for transferring the composite toner image from said intermediate transfer belt to the recording medium, and including a secondary transfer belt having a medium resistance, secondary transfer means, and conductive elastic means;

wherein said secondary transfer belt extends in the direction of transport, wherein said secondary transfer means faces a portion of an inner periphery of said secondary transfer belt downstream of the downstream one of said two secondary transfer rollers with respect to the direction of transport, and wherein said conductive elastic means faces upstream one of said two secondary transfer rollers with respect to the direction of transport with the intermediary of said second transfer belt, and is connected to ground.

8. An apparatus as claimed in claim 7, further comprising cleaning means held in contact with said secondary transfer means.

9. An apparatus as claimed in claim 7, wherein said conductive elastic means comprises a roller formed of a conductive foam material.

10. An apparatus as claimed in claim 9, further comprising cleaning means held in contact with said secondary transfer means.

11. An apparatus as claimed in claim 7, wherein said conductive elastic means comprises a conductive brush.

12. An apparatus as claimed in claim 11, further comprising cleaning means held in contact with said secondary transfer means.

13. An image forming apparatus comprising:

a primary transfer unit for sequentially transferring toner images of different colors from a photoconductive element to an intermediate transfer belt to thereby form a composite color image on said intermediate transfer belt; and a secondary transfer unit for transferring the composite toner image from said intermediate transfer belt to a recording medium, and including a secondary transfer belt extending in a direction of transport in which the recording medium is conveyed, and secondary transfer means facing an inner periphery of said secondary transfer belt;

a discharger and a ground member facing each other with said secondary transfer belt being an intermediary;

wherein said intermediate transfer belt is formed of a material having a volume resistivity of $10^8$ Ωcm to $10^{10}$ Ωcm, and wherein said secondary transfer belt is formed of a material having a volume resistivity of higher than $10^{11}$ Ωcm inclusive.

* * * * *